US009605536B2

(12) United States Patent
Mickael

(10) Patent No.: US 9,605,536 B2
(45) Date of Patent: Mar. 28, 2017

(54) ACOUSTIC DATA COMPRESSION TECHNIQUE

(71) Applicant: Weatherford Technology Holdings, LLC, Houston, TX (US)

(72) Inventor: Medhat Mickael, Sugar Land, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 14/752,111

(22) Filed: Jun. 26, 2015

(65) Prior Publication Data

US 2016/0003036 A1 Jan. 7, 2016

Related U.S. Application Data

(60) Provisional application No. 62/020,085, filed on Jul. 2, 2014.

(51) Int. Cl.

| | |
|---|---|
| ***E21B 47/16*** | (2006.01) |
| ***E21B 47/14*** | (2006.01) |
| ***E21B 47/18*** | (2012.01) |

(52) U.S. Cl.

CPC ..... *E21B 47/14* (2013.01); *E21B 47/16* (2013.01); *E21B 47/18* (2013.01)

(58) Field of Classification Search

CPC ..... E21B 47/14; E21B 47/18; E21B 47/16

See application file for complete search history.

(56) References Cited

U.S. PATENT DOCUMENTS

| | | | | |
|---|---|---|---|---|
| 5,594,706 | A | 1/1997 | Shenoy et al. | |
| 8,238,194 | B2 | 8/2012 | Wu et al. | |
| 2002/0093879 | A1 | 7/2002 | Mandal | |
| 2006/0083108 | A1 | 4/2006 | Wu | |
| 2007/0097786 | A1* | 5/2007 | Wu | G01V 11/002 367/31 |
| 2012/0096935 | A1* | 4/2012 | Finke | E21B 47/01 73/152.03 |
| 2016/0130931 | A1* | 5/2016 | Lou | E21B 47/0005 175/40 |

OTHER PUBLICATIONS

Combined Search and Examination Report in counterpart UK Appl. GB 1511650.2, dated Oct. 20, 2015.

First Office Action in counterpart Canadian Appl. 2,895,600, dated Sep. 27, 2016, 4-pgs.

* cited by examiner

*Primary Examiner* — Erin File

(74) *Attorney, Agent, or Firm* — Blank Rome LLP

(57) ABSTRACT

Acoustic data acquired in a MWD/LWD system can be compressed for transmission to the surface. The compression technique can include semblance processing acoustic signals received at a plurality of receivers spaced apart from a transmitter to generate a semblance projection at each of a plurality of depths. Peaks of the semblance projection can then be telemetered to the surface, with each peak including a slowness (velocity) value and a coherence (semblance) value. The telemetered values may be processed at the surface to generate logs as a function of depth.

20 Claims, 5 Drawing Sheets

ACOUSTIC DATA COMPRESSION TECHNIQUE

BACKGROUND

Acoustic logging is frequently used in oil and gas operations to determine various properties of an earth formation in which a borehole has been drilled. Many acoustic logging data processing and analysis techniques were developed in conjunction with wireline acoustic logging tools, which are run in the wellbore after drilling is completed. These tools are operatively electrically connected to surface processing equipment by the wireline, which allows relatively large quantities of acoustic data to be transmitted to the surface for analysis. With the advent of measuring while drilling (MWD) and/or logging while drilling (LWD) systems, the wireline connection was no longer available. (Throughout this document LWD will be used to refer to both MWD and LWD systems.) Although there are a variety of techniques for communicating with LWD tools during the drilling operation, including, for example, electromagnetic and mud pulse telemetry, these channels tend to be somewhat bandwidth constrained as compared to wireline applications. As a result, many of the data processing and analysis techniques that were developed using wireline tools were adapted to perform more processing downhole and limit the amount of data that is transmitted to the surface.

For example, acoustic logging is often undertaken to determine compressional and shear wave velocities of the formation. These velocities can subsequently be used to determine other parameters of interest, such as, porosity, lithology, and pore pressure, all of which relate to the amount of oil or other hydrocarbons in the formation and/or the ease with which the hydrocarbons can be recovered. The velocities (as well as Stonely velocities and other parameters) can be determined as a function of depth using a technique known as semblance processing. Advances in downhole tool design and capabilities have permitted better semblance processing results to be generated downhole, yet the problem of getting this data to the surface remains. Historically, various (usually lossy) compression techniques have been used. Unfortunately, these techniques have often resulted in less-than-optimal results, as too much data is sacrificed to comply with bandwidth limits. The data lost as a result of these techniques can often lead to ambiguities in the data transmitted to drilling engineers at the surface, resulting in sub-optimal decisions relating to both the steering of the wellbore and appropriate completions techniques. Thus, what is needed is a better technique for compressing acoustic data measured and/or generated by a downhole LWD system so that more and/or better information can be transmitted to the surface despite the constraints of commonly used downhole telemetry systems. Although disclosed in the context of LWD systems, such data compression techniques could also be used in wireline systems.

DETAILED DESCRIPTION

Figure 1:
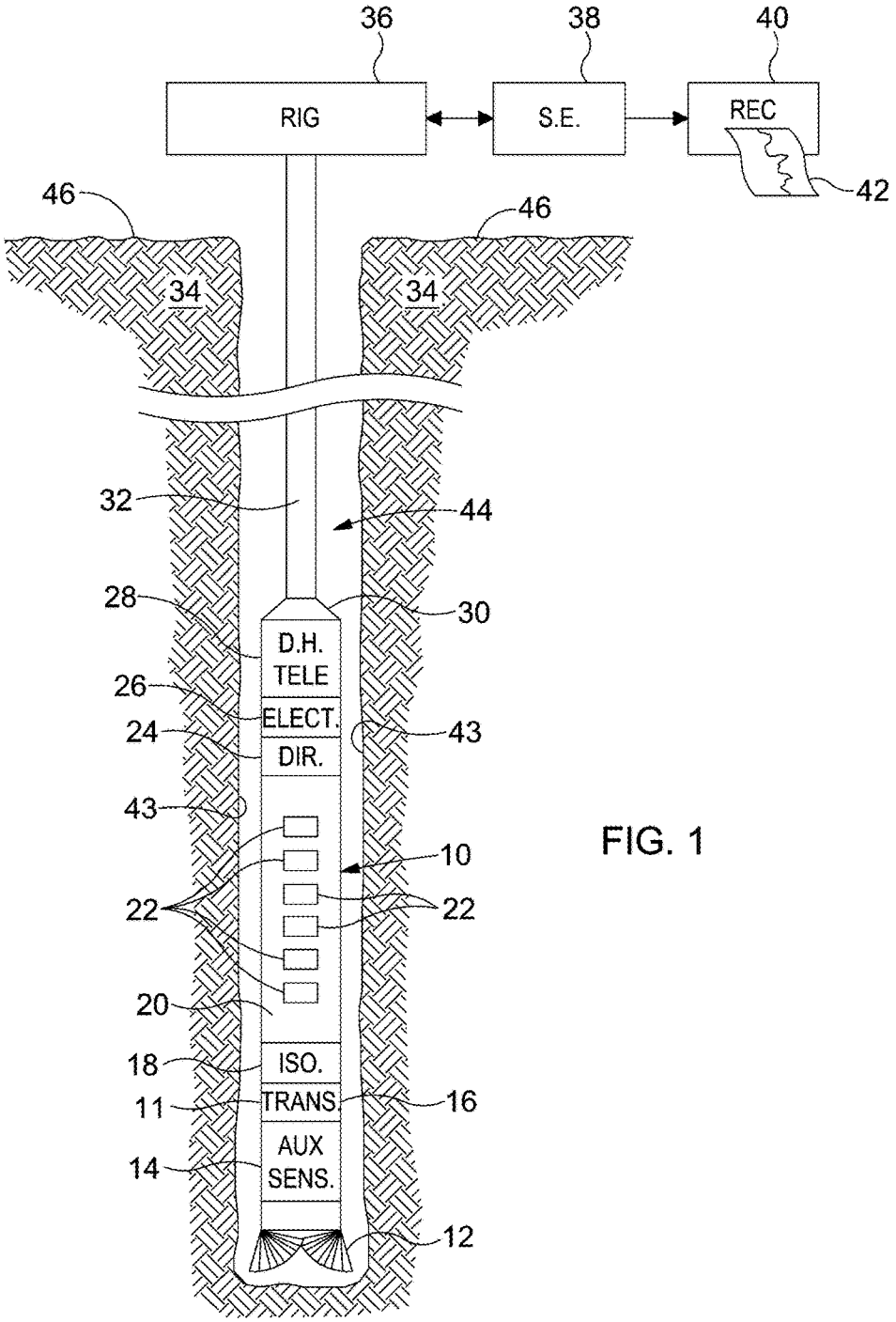
FIG. 1 illustrates an exemplary LWD acoustic logging system.

FIG. 1 illustrates an LWD acoustic system disposed in a borehole drilling environment. The LWD borehole instrument or "tool" component of the borehole assembly is designated as a whole by the numeral 10, and comprises a pressure housing 11, which is typically a drill collar. The tool 10 is disposed within a well borehole 44 defined by borehole walls 43 and penetrating earth formation 34. A drill bit 12 terminates a lower end of the tool 10, and a connector 30 terminates an upper end of the tool. The connector 30 operationally connects the tool 10 to a lower end of a drill string 32. The upper end of the drill string terminates at a rotary drilling rig 36, which is known in the art and is illustrated conceptually at 36.

Again referring to FIG. 1, the tool 10 comprises a transmitter 16 and a receiver assembly 20. An acoustic isolation section 18 separates the transmitter 16 from the receiver assembly 20. The receiver section 20 comprises a plurality of receivers 22 axially spaced from the transmitter 16. Six receivers are illustrated for purposes of discussion, although more or fewer receivers can be used. The receivers 22 are also shown axially aligned, although axial alignment is not required if the transmitter firing sequence is suitably adjusted.

In the embodiment shown in FIG. 1, the tool comprises a directional section 24 that provides a real time measure of azimuthal angle therefore provides azimuthal orientation of the tool 10 within the borehole 44. The directional section 24 can comprise magnetometers, accelerometers, or both magnetometers and accelerometers. The tool 10 can optionally comprise an auxiliary sensor section 14 with one or more auxiliary sensors responsive to a variety of borehole environs parameters. It should be understood that the acoustic measurement system disclosed herein does not necessarily require measurements from the auxiliary sensor section 14. An electronics section 26 provides power and control circuitry for the acoustic transmitter 16, receiver elements 22 of the receiver section 20, the directional section 24, and any auxiliary sensors in the auxiliary sensor section 14. Power is typically supplied by batteries, but may be supplied by a mud powered turbine generator (not shown).

Still referring to FIG. 1, a down-hole processor unit (not shown) is preferably located within the electronics section 26. The processor receives and processes responses from the receiver elements 22. The processor also controls, among other things, the firing of the transmitter 16 as a function of information received from the directional section 24. The electronics section 26 is operationally connected to a downhole telemetry unit 28. Data, from elements within the tool 10, whether processed downhole as parameters of interest or in the form of "raw" data, are telemetered to the surface 46 of the earth by means of a suitable telemetry system.

Suitable telemetry systems include a mud pulse system, and electromagnetic telemetry system, or an acoustic telemetry system that uses the drill string 32 as a data conduit. The telemetered data are received by an up-hole telemetry element (not shown) preferably disposed in a surface equipment module 38. As the borehole assembly comprising the logging tool 10 is conveyed along the borehole 44 by the drill string 32, one or more parameter of interest, or alternately raw data, are input to a recorder 40. The recorder 40 tabulates the data as a function of depth within the borehole 44 at which they are measured. The recorder output 42 is typically a "log" of the data as a function of borehole depth. The data can alternately be recorded in down-hole processor memory (not shown), and subsequently downloaded to the surface equipment module 38 when the tool 10 is returned to the surface 46 during or after the drilling operation is completed. The downloaded data are typically processed further within the surface equipment module 38 to obtain additional parameters of interest that cannot be determined in the down-hole processor unit.

As stated previously, the pressure housing 11 is typically a steel drill collar with a conduit through which drilling fluid flows. Elements of the tool 10 illustrated conceptually in FIG. 1 are typically disposed within the wall of the drill collar pressure housing 11.

Figure 2:
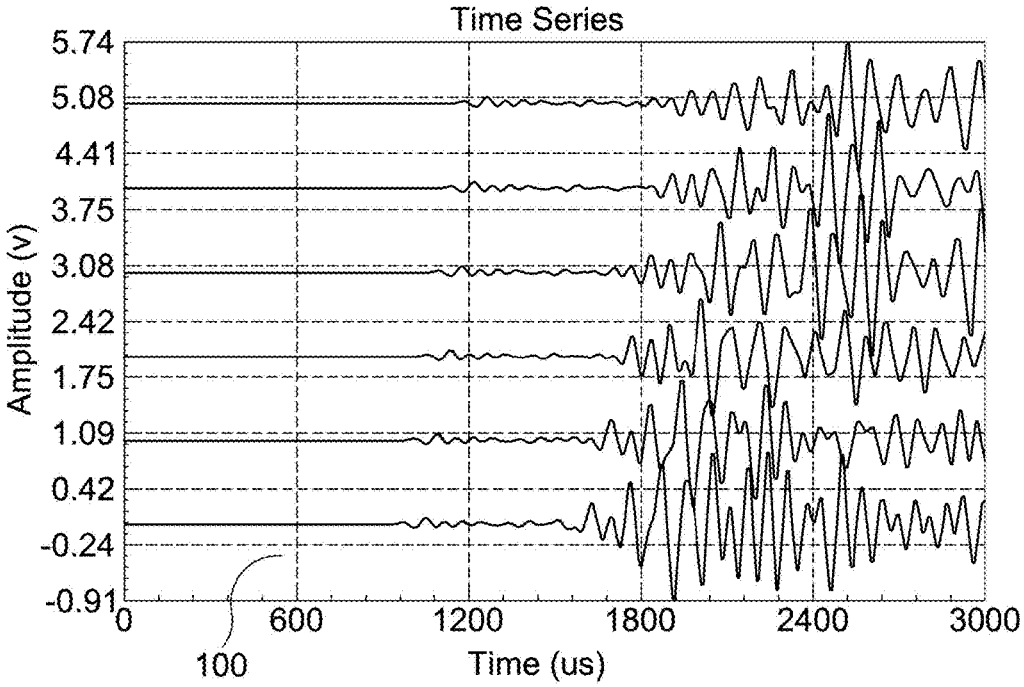
FIG. 2 illustrates an exemplary plot of acoustic signals received by a plurality of receivers of an acoustic logging system.

FIG. 2 illustrates acoustic signals 100 received by the plurality of receivers 22. Each acoustic signal is a plot of amplitude (in arbitrary units) versus time. The lowermost signal corresponds to the signal from the receiver 22 nearest transmitter 16, with the next higher signal corresponding to the next nearest receiver, etc. As can be seen, the receivers located farther from the transmitter will experience signal arrival at a later time. Semblance processing techniques can be applied to acoustic signals 100 like those illustrated in FIG. 2 to generate a semblance map like that illustrated in FIG. 3.

Figure 3:
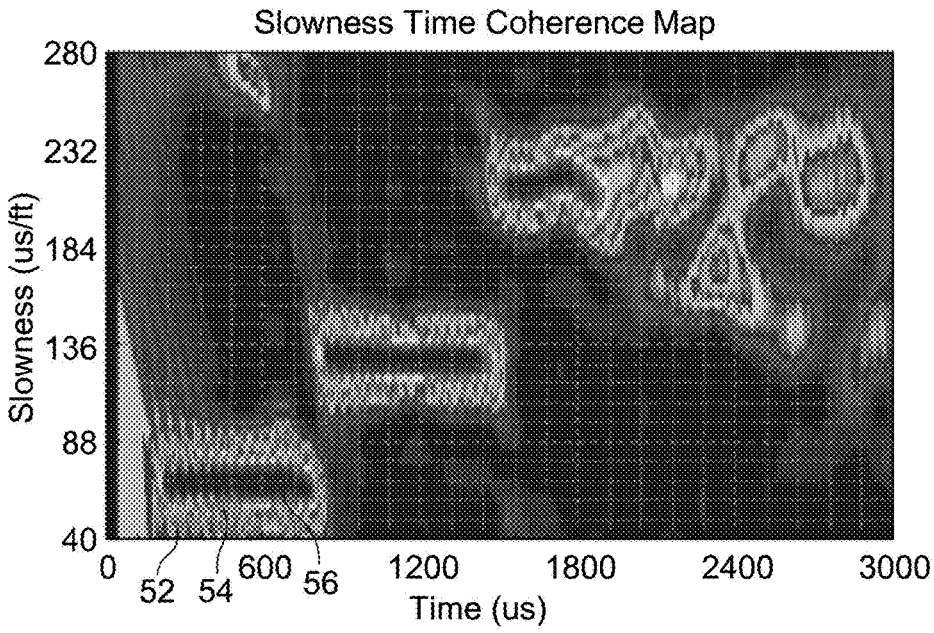
FIG. 3 illustrates an exemplary semblance plot based on acoustic signals received by a plurality of receivers of an acoustic logging system.

FIG. 3 shows a conceptual slowness time coherence ("STC") map (a/k/a "semblance map") of an acoustic data set like that illustrated in FIG. 2. The semblance map has been conceptualized for brevity and comprises a plot of slowness (ordinate) as a function of arrival times from the wave field responses recorded by the receivers 22 shown in FIG. 1. Slowness and arrival times are expressed in units of microseconds per foot (us/ft) and microseconds (us), respectively. Contours 52, 54 and 56 indicate values of increasing magnitude of coherence, typically expressed as a percentage. In practice, semblance maps are typically depicted in color. For example, low coherence values might be depicted in blue to green shades, with intermediate coherence values depicted by yellow shades, with the highest coherence values depicted by orange to red shades. The exemplary semblance map illustrated in FIG. 3 shows a compressional wave arrival at lower left. Moving upward and to the right (i.e., slower/later arrivals), the compressional wave arrival is followed by a shear arrival, and other arrivals, which could be Stonely or fluid wave arrivals, etc.

Figure 4:
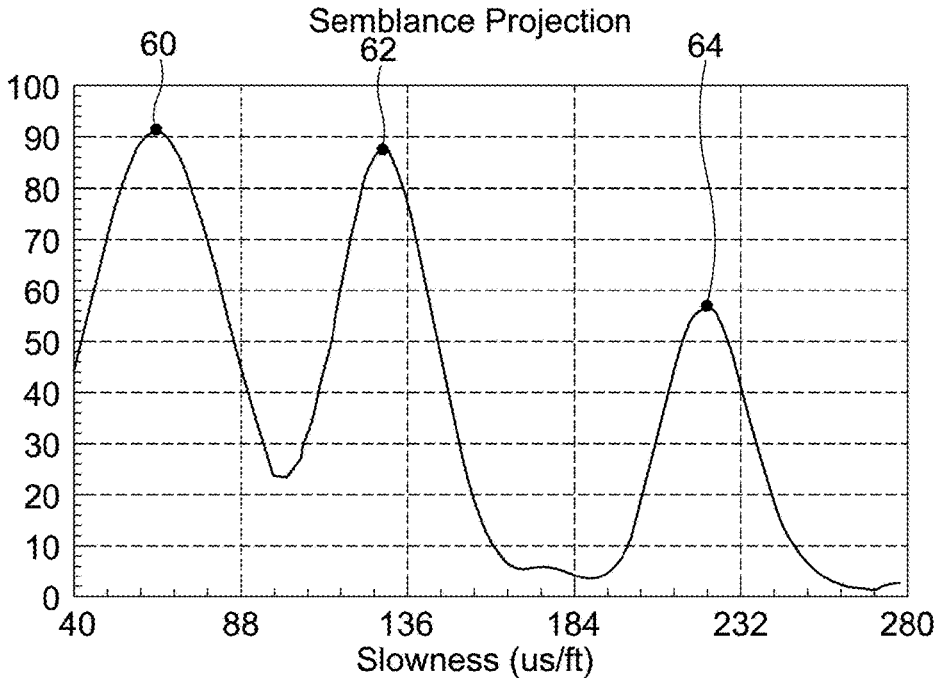
FIG. 4 illustrates an exemplary semblance projection based on the semblance plot of FIG. 3.

FIG. 4 illustrates a semblance projection of the semblance map illustrated in FIG. 3. In this plot, semblance expressed as a percentage (ordinate) is plotted as a function of slowness (us/ft). This semblance projection provides key information to a drilling engineer, primarily in the values of the peaks for the various arrivals. For example, the peak 60 indicates the compression velocity (slowness) of the formation, peak 62 indicates the shear velocity (slowness) of the formation, and peak 64 indicates the Stonely velocity (slowness) of the formation or a borehole fluid arrival.

Figure 4B:
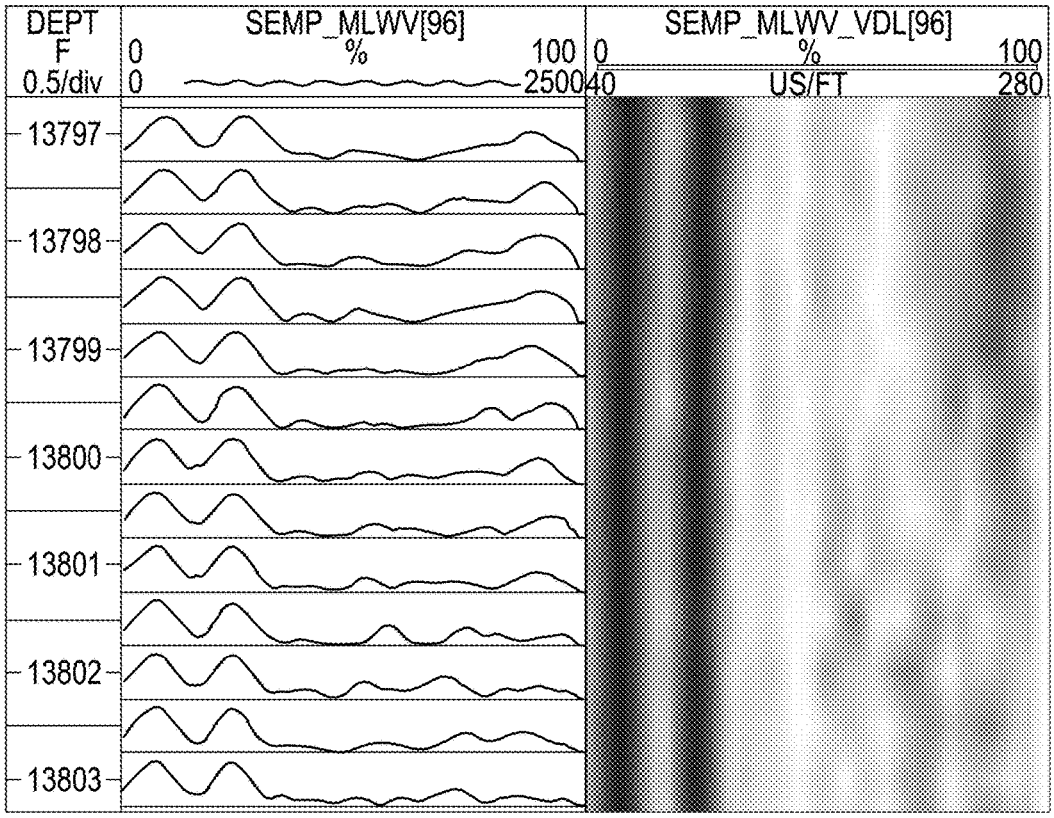
FIG. 4B illustrates an example of a plurality of semblance projections assembled into a variable density log (VDL).

Each of the foregoing plots discussed with reference to FIGS. 2, 3 and 4 are indicative of parameters measured only at a certain depth. In practice, it is frequently desirable to obtain semblance projections like that illustrated in FIG. 4 at a plurality of depths. This collection of semblance projections can be used to generate a log of pertinent velocities (or other parameters derived therefrom) as a function of depth. An example of such a log is illustrated in FIG. 4B. In FIG. 4B, increasing depth is illustrated downward on the vertical axis. Slowness is illustrated on the horizontal axis, with slowness increasing (velocity decreasing) in the rightward direction. Semblance is illustrated on the left as a curve and on the right as a variable density log (VDL) by shading the curves, with darker values corresponding to higher semblance values.

Figures 5A, 5B:
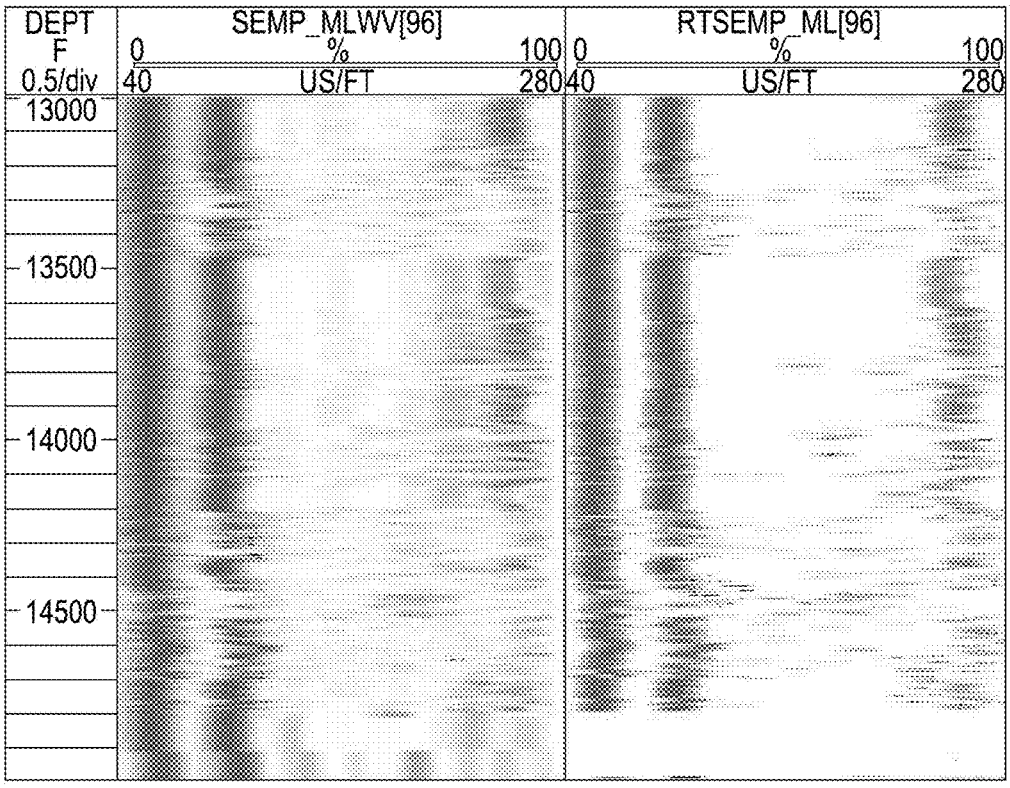
FIG. 5A illustrates an exemplary log generated from semblance projections as a function of depth.
FIG. 5B illustrates the log of FIG. 5A using the compression techniques disclosed herein.
Figures 6A, 6B:
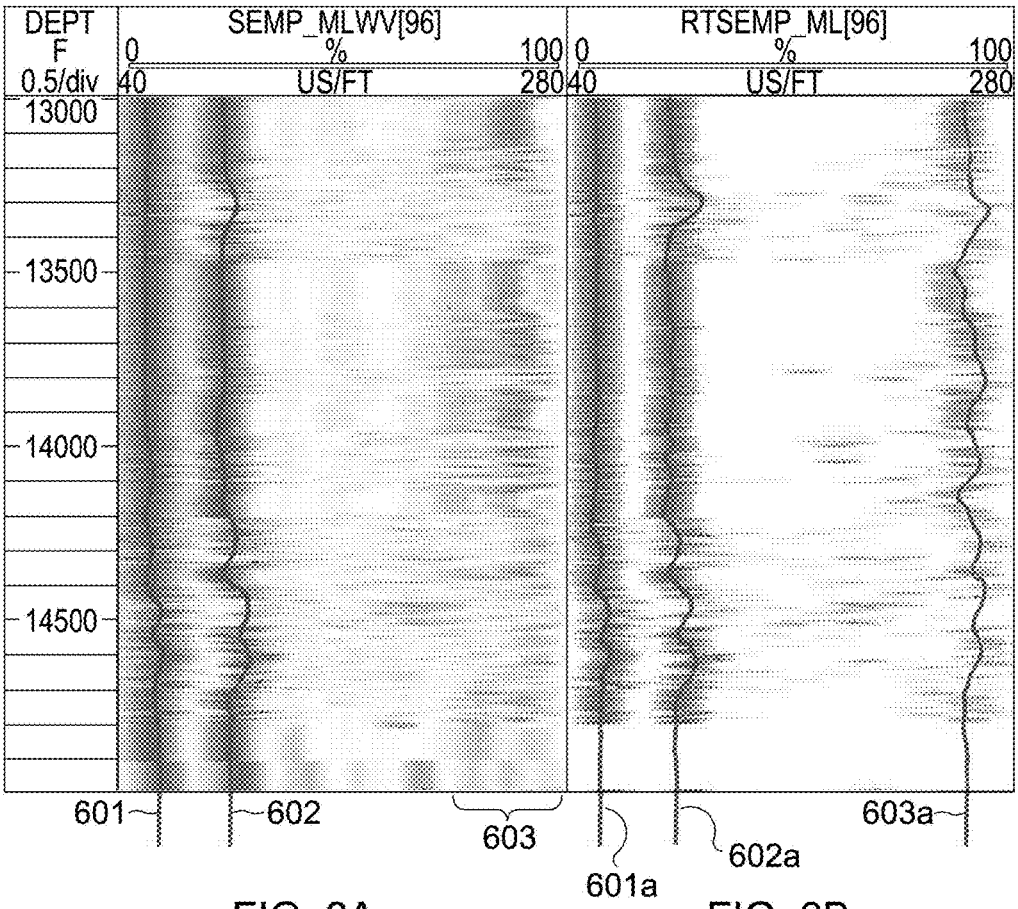
FIG. 6A illustrates the exemplary log of FIG. 5A with compression and shear velocity as a function of depth superimposed thereon.
FIG. 6B illustrates the log of FIG. 6A using the compression techniques disclosed herein.

FIG. 5A illustrates an exemplary variable density log. FIG. 6A illustrates a variation of FIG. 5A in which a compressional velocity as a function of depth curve 601 has been superimposed. Additionally, a shear velocity as a function of depth curve 602 has been superimposed. Further inspection of FIG. 6A shows that there may be an additional relatively slower arrival in region 603 illustrated at the far right of FIG. 6A. However, interpretation of such an arrival is somewhat complicated by the faintness and relatively low semblance. In any case, this type of information is highly useful to a drilling engineer in seeking to steer a wellbore for optimal recovery of hydrocarbons.

While the plots illustrated in FIG. 5A and 6A are highly useful, transmission of such curves in real time during a LWD operation requires a prohibitively large amount of data. Thus, historically, one approach has been to only transmit the slowness value corresponding to peak semblance for each depth. As an example, eight bits might be allocated to each of two peaks for a given depth; the two peaks corresponding to a compression velocity and a shear velocity at that depth. This allows curves 601 and 602 to be regenerated at the surface. One significant problem with this approach has been realized when transitioning from a fast to a slow formation. In such a transition, the compression slowness may fairly suddenly transition from a relatively low value (in the fast formation) to a higher value (in the slow formation) that generally corresponds to the shear velocity in the faster formation. In such a case, another peak may be lost due to sampling frequency or other measurement limitations. In such a case, without all of the other data being sacrificed as a result of the somewhat crude compression techniques, it might not be recognized that there had been a transition from a fast to a slow formation. Obviously this information would be of significant importance to the drilling engineer, and thus its masking by the prior art compression technique is somewhat problematic.

To address these deficiencies, other compression techniques based on wavelet compression have been introduced. These techniques generally operate as follows: for each depth, a semblance projection like that illustrated in FIG. 4 is divided along the horizontal axis into multiple bins, e.g., 96 bins. If an 8-bit value for each bin were to be transmitted, a total of 768 (96×8) bits per depth would be required. However, using wavelet compression this can be compressed into 32 bits per depth. This requires a "smearing" of the semblance projection, caused by collapsing six bins into one, for a total of 16 bins. While this compression technique is effective, the resultant "smearing" can cause the peak to be shifted to the left or right, corresponding to a decrease or increase in slowness. The introduced measurement error is itself undesirable for obvious reasons.

To overcome these deficiencies of prior compression techniques, the inventor has developed the following compression technique. First, for each depth, velocity values corresponding to the first three peaks of the semblance projection (e.g., peaks 60, 62, and 64 illustrated in FIG. 4) will be telemetered to the surface. In addition to the velocity values corresponding to the peaks, the semblance value (a/k/a "coherence") will also be transmitted. Transmission of the semblance values makes it easier to follow movement of the peak as a function of depth. In other words, sending the peak plus the coherence allows an image corresponding to that in FIGS. 5A and 6A to be reproduced. Such reconstructed images are illustrated in FIGS. 5B and 6B, respectively. In general the added coherence data allows the curvature of the peak in the vicinity of the peak to be inferred. In other words, giving color to the point allows correlation between depths of which peaks are which. Thus, even in the event of a dramatic shift from a faster formation to a slower formation, compression velocities can still be associated with compression velocities, shear with shear, etc.

Additionally, further refinement possible based on the known properties of the measurement system. For example, peak width is generally a function of transmitter frequency and receiver spacing. Thus, when generated reconstructed curves illustrated in FIGS. 5B and 6B, the plotting program can be customized to reintroduce appropriate curvature. As can be seen by comparing FIG. 5B to 5A and 6B to 6A, the compression technique described herein conveys all of the pertinent information in the original plots while dramatically reducing the number of bits required to convey the information. As can be further seen, by comparing FIG. 6B to FIG. 6A, it is quite easy to trace the velocities as a function of depth for the compression velocity 601*a*, the shear velocity 602*a*, and the third arrival 603*a*, which quite difficult to make out in FIG. 6A.

In one embodiment, 10 bits can be allocated to each of three peaks, with 7 bits for the velocity (slowness) value and three bits allocated to the coherence value of each peak. This allows two extra bits to be used for enhanced precision while still matching the total of 32 bits per depth realized by the wavelet compression technique described above. Of course, other numbers of bits or bit allocations could also be used while using the same principle of compression.

Some portions of the detailed description were presented in terms of processes, programs and workflows. These processes, programs and workflows are the means used by those skilled in the data processing arts to most effectively convey the substance of their work to others skilled in the art. A process or workflow is here, and generally, conceived to be a self-consistent sequence of steps (instructions) contained in memory and run or processing resources to achieve a desired result. The steps are those requiring physical manipulations of physical quantities. Usually, though not necessarily, these quantities take the form of electrical, magnetic or optical signals capable of being stored, transferred, combined, compared and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing," "receiving," "calculating," "determining," "displaying," or the like, refer to the action and processes of a computer system, or similar electronic computing device, that manipulates and transforms data represented as physical (electronic) quantities within the computer system memories or registers or other such information storage, transmission or display devices.

The present invention also relates to an apparatus for performing the operations herein. This apparatus may be specially constructed for the required purposes, or it may comprise a general-purpose computer, selectively activated or reconfigured by a computer program stored in the computer. Such a computer program may be stored in a computer readable storage medium, which could be, but is not limited to, any type of disk including floppy disks, optical disks, CD-ROMs, an magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Furthermore, the computers referred to in the specification may include a single processor, or may be architectures employing multiple processor designs for increased computing capability.

The systems and techniques described herein are not inherently related to any particular computer or other apparatus. Various general-purpose systems may also be used with programs in accordance with the teachings herein, or it may prove convenient to construct more specialized apparatus to perform the required method steps. The required structure for a variety of these systems will appear from the description above. In addition, the present invention is not described with reference to any particular programming language, software application, or other system. It will be appreciated that a variety of languages, applications, systems, etc. may be used to implement the teachings of the present invention as described herein, and any references to specific languages, applications, or systems are provided only for purposes of enabling and disclosing the best mode of practicing the invention.

The invention claimed is:

1. A method of acquiring and processing acoustic data in a logging while drilling (LWD) system, the method comprising:

firing an acoustic transmitter;

receiving acoustic signals at a plurality of receivers spaced apart from the transmitter, said acoustic signals having interacted with a formation;

semblance processing by generating data indicative of slowness as a function of arrival time from the received acoustic signals and generating a semblance projection from the generated data for each of a plurality of depths; and telemetering one or more peak values of said semblance projection for each of the plurality of depths to the surface, wherein the one or more telemetered peak values include at least a slowness measurement and a coherence value.

2. The method of claim 1 wherein the one or more peak values comprise three peak values.

3. The method of claim 2 wherein the three peak values are each represented by seven bits corresponding to the slowness measurement and three bits corresponding to the coherence value.

4. The method of claim 3 wherein the three peak values are represented by two additional bits for enhanced precision.

5. The method of claim 1 wherein telemetering one or more peak values includes the use of mud pulse telemetry.

6. The method of claim 1 wherein telemetering one or more peak values includes the use of wired drill pipe.

7. A logging while drilling (LWD) system comprising an LWD borehole instrument comprising a pressure housing, a drill bit operatively coupled to a lower end of the borehole instrument, and a connector operatively connecting the borehole instrument to a drill string at an upper end of the borehole instrument, the borehole instrument further comprising:

an acoustic transmitter;

an acoustic receiver assembly comprising a plurality of receivers axially spaced from the transmitter; and an electronics section that provides power and control circuitry for the acoustic transmitter and acoustic receiver assembly, the electronics section further comprising a downhole processor unit configured to:

fire the acoustic transmitter;

receive acoustic signals from the acoustic receiver assembly, said acoustic signals having interacted with a formation;

perform semblance processing to generate data indicative of slowness as a function of arrival time from the received acoustic signals and to generate a semblance projection from the generated data for each of a plurality of depths; and telemeter one or more peak values of said semblance projections for each of the plurality of depths to the surface, wherein the one or more telemetered peak values include at least a slowness measurement and a coherence value.

8. The LWD system of claim 7 wherein the pressure housing is a drill collar.

9. The LWD system of claim 7 wherein the electronics section further comprises a downhole memory coupled to the downhole processor unit and wherein the downhole processor unit is further configured to store the generated semblance projections in the downhole memory.

10. The LWD system of claim 7 wherein the one or more peak values comprise three peak values of a slowness measurement.

11. The LWD system of claim 10 wherein the three peak values are each represented by seven bits corresponding to the slowness measurement and three bits corresponding to the coherence value.

12. The LWD system of claim 11 wherein the three peak values are represented by two additional bits for enhanced precision.

13. The LWD system of claim 7 further comprising a mud pulse telemetry unit for use by the downhole processor unit in telemetering the one or more peak values of the semblance projections.

14. The LWD system of claim 7 further comprising a wired drill pipe telemetry unit for use by the downhole processor unit in telemetering the one or more peak values of the semblance projections.

15. An electronics section for a logging while drilling (LWD) system comprising a downhole processor configured to:

fire an acoustic transmitter of an LWD tool;

receive acoustic signals from an acoustic receiver assembly of an LWD tool, the acoustic receiver assembly comprising a plurality of receivers spaced apart from the acoustic transmitter, the acoustic signals having interacted with a formation;

perform semblance processing to generate data indicative of slowness as a function of arrival time from the received acoustic signals and to generate a semblance projection from the generated data for each of a plurality of depths; and telemeter one or more peak values of said semblance projections for each of the plurality of depths to the surface, wherein the one or more telemetered peak values include at least a slowness measurement and a coherence value.

16. The electronics section of claim 15 wherein the one or more peak values comprise three peak values of a slowness measurement.

17. The electronics section of claim 16 wherein the three peak values are each represented by seven bits corresponding to the slowness measurement and three bits corresponding to the coherence value.

18. The electronics section of claim 15 wherein the three peak values are represented by two additional bits for enhanced precision.

19. The electronics section of claim 15 wherein telemetering one or more peak values includes the use of mud pulse telemetry.

20. The electronics section of claim 15 wherein telemetering one or more peak values includes the use of wired drill pipe.

* * * * *